United States Patent [19]

MacDonald

[11] 4,308,770

[45] Jan. 5, 1982

[54] ALLEN WRENCH HANDLE

[75] Inventor: Paul M. MacDonald, Scituate, Mass.

[73] Assignee: P.X. Industries, Inc., West Hanover, Mass.

[21] Appl. No.: 106,479

[22] Filed: Dec. 26, 1979

[51] Int. Cl.[3] ..... B25B 13/00

[52] U.S. Cl. ..... 81/177 A

[58] Field of Search ..... 81/71, 177 R, 177 A, 81/177 F, 177 G; 279/14, 89, 93; 145/50 C, 61

[56] References Cited

U.S. PATENT DOCUMENTS

| | | | |
|---|---|---|---|
| 1,172,656 | 2/1916 | Yorgensen | 81/177 A |
| 1,239,394 | 9/1917 | Hovhannesian | 145/50 C |
| 3,113,479 | 12/1963 | Swingle | 81/71 X |
| 3,850,056 | 11/1974 | Allen | 81/177 A X |

*Primary Examiner*—James G. Smith

*Attorney, Agent, or Firm*—Morse, Altman, Oates & Dacey

[57] ABSTRACT

A handle is provided for use with an Allen wrench by means of which leverage and grip on the wrench is improved and protection is provided in the event that the wrench should break during use. The handle is comprised of an elongated shank portion having an axial passage therein to receive the long end of the wrench. A head is provided at the end of the shank portion and formed with a recess perpendicular to and open to the shank passage to receive the short end of the wrench. Releasable retaining means are provided to hold the end of the wrench within the handle during operation thereof.

9 Claims, 11 Drawing Figures

ALLEN WRENCH HANDLE

BACKGROUND OF THE INVENTION

1. Field of the Invention

This invention relates generally to hand tools and more particularly is directed towards a new and improved safety handle for use with Allen wrenches and similar L-shaped tools.

2. Description of the Prior Art

Allen wrenches have been in common use for a great many years and are employed in variety of assembly and repair procedures for turning Allen screws. Similar L-shaped tools may be fitted with sockets or other heads for various purposes. The wrench normally is of the same dimensions throughout and, in practice, is fabricated from a length of hexagonal cross-section stock steel rods that are bent into an L-shape. The resulting tool is somewhat slender and therefore difficult to use when applying pressure, particularly in the smaller sizes. Also, the long end of the tool tends to be somewhat short so as to provide insufficient leverage in many instances. A more serious drawback with the Allen wrench is that under excessive pressure the wrench will snap, usually at the bend. When the wrench snaps, often times pieces of metal will fly from the broken tool presenting a hazard to those in the immediate vicinity.

While various types of handles have been proposed for use with Allen wrenches, none of these has been proven to be entirely satisfactory from the standpoint of simplicity, safety, each of changing tools and the like.

Accordingly, it is an object of the present invention to provide a new and improved handle for use with Allen wrenches and similar L-shaped tools.

Another object of this invention is to provide a handle for use with Allen wrenches and the like which allows for the quick and easy exchange of Allen wrenches of different sizes.

Another object of this invention is to provide a handle for an Allen wrench or the like which substantially fully encloses the wrench during use as a protection in the event of breakage of the wrench from excessive pressure applied thereto.

SUMMARY OF THE INVENTION

This invention features a handle for use with an Allen wrench or the like, comprised of an elongated shank portion formed with an axial passage therein open to at least one end of the shank to receive the long end of an Allen wrench inserted therein. A head mounted at the one end of the shank portion is formed with a socket open to the shank passage and to one side of the head to receive the short portion of the Allen wrench and to allow the driving tip thereof to extend from the side of the head. Releasable retaining means are provided across the open end of the socket to hold the wrench in place during use thereof.

DETAILED DESCRIPTION OF THE PREFERRED EMBODIMENTS

Figure 2:
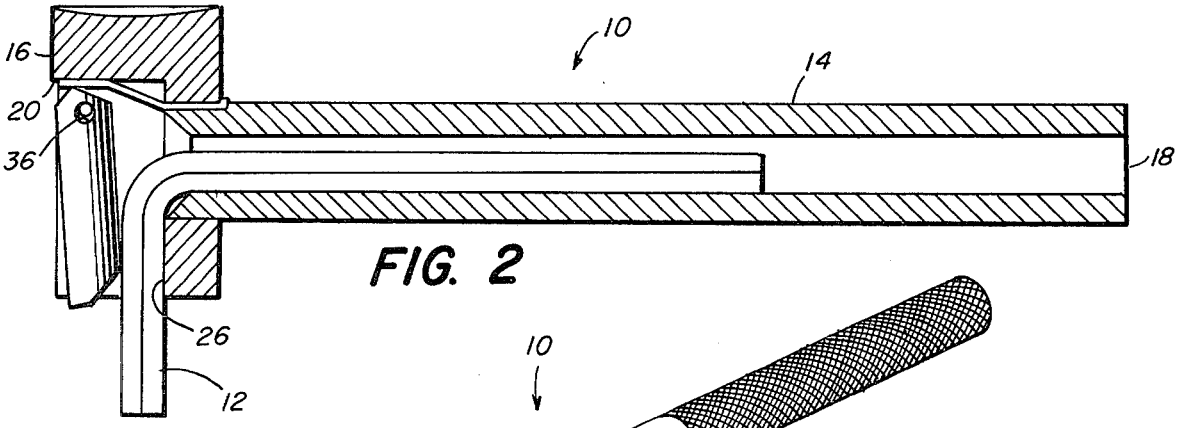
FIG. 2 is a sectional view in side elevation thereof.
Figure 1:
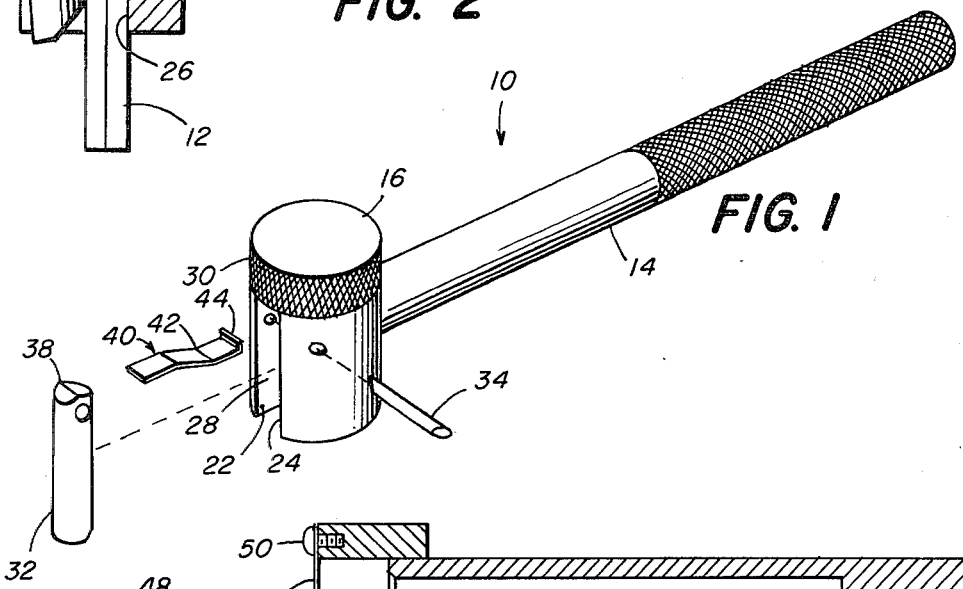
FIG. 1 is an exploded perspective view of an Allen wrench handle made according to the inventiton.
Figure 3:
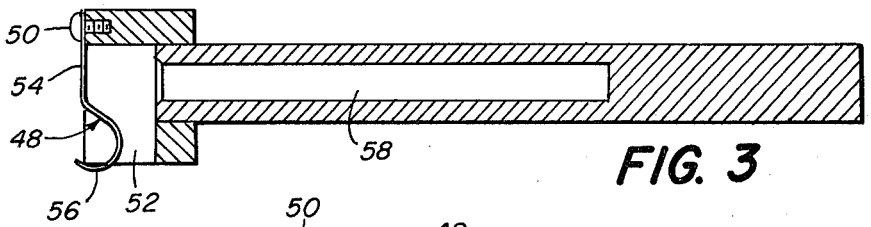
FIG. 3 is a sectional view in side elevation of a modified Allen wrench handle made according to the invention.
Figure 4:
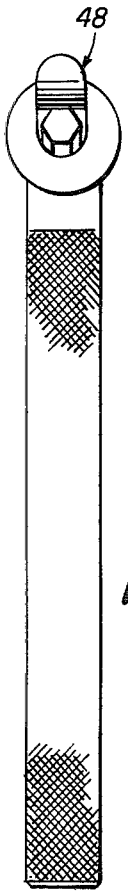
FIG. 4 is a view in front elevation thereof.
Figure 5:
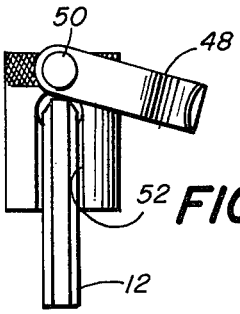
FIG. 5 is an end view thereof.
Figure 6:
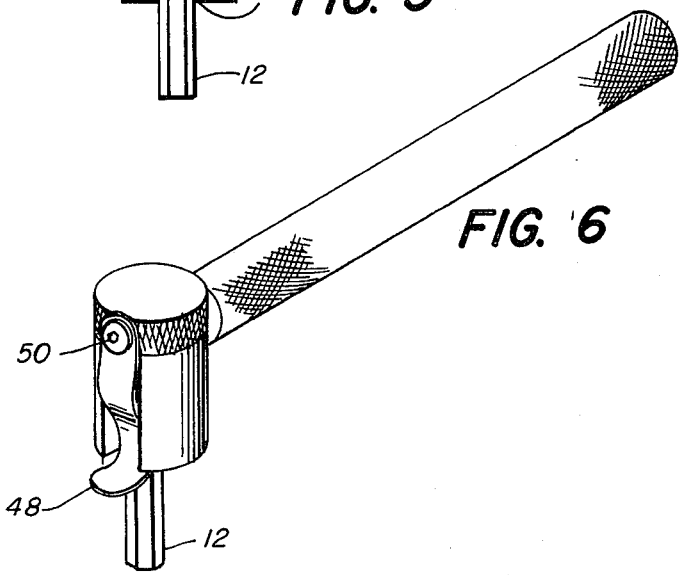
FIG. 6 is a perspective view thereof.

Referring now to the drawings and to FIGS. 1 and 2 in particular, the reference character 10 generally indicates a handle for use with a standard Allen wrench 12 generally comprised of an elongated shank portion 14 and a head portion 16 at one end thereof. The handle may also be used with other L-shaped hand tools. The handle may be made up in a wide variety of different sizes depending upon the sizes of Allen wrenches to be used with it. However, by way of example, when using the handle with an Allen wrench having a length of about 3" on the long leg thereof, a handle 10 with an overall length of about 5" is employed. An Allen wrench in a 3" length typically is about 3/16" in diameter and has a short driving neck about 1" long.

The shank 14 and head 16 preferably are fabricated from a high strength metal and for this purpose aluminum, steel or brass may be used to advantage. Other high strength material such as certain strong, rigid plastics may also be employed. The shank portion is formed with an axial passage 18 extending over substantially the entire length thereof and may, if desired, extend the full length thereof. The depth of the passage in any event should be sufficient to accommodate the long end of an Allen wrench inserted therein and the width should similarly be dimensioned to accommodate a wrench of that size. For a handle intended for use with a wrench of the size indicated above, the depth of the passage should be 3⅜ to 4" and its width should be on the order of ½". Obviously, these dimensions are only by way of example and may be varied through a wide range depending upon the particular sizes of wrenches intended to be used with the handle.

The outer surface of the shank portion should provide a frictional grip and for this purpose the surface may be knurled, as illustrated, grooved or ribbed or provided with some other type of textured finish to enhance the grip thereon.

The head 16 typically is generally cylindrical in shape although other configurations may also be used. The head may be fabricated integral with the shank portion or may be a separate piece attached to the end of the shank portion by means of press fitting the same thereon or by a screw fit in which the left hand of the shank portion as viewed in FIG. 1 is threaded about its outer end while the head is formed with a tapped socket to receive the threaded end of the shank portion.

In any event the head 16 is formed with a rear wall 20 side walls 22 and 24 and a bottom wall 26 which define a socket 28 which is open at the end and at the side of the head to allow insertion and removal of an Allen wrench 12. Typically, the head 16 may be on the order of 1" in length in a handle 10 of the size described above. The head should be more or less centered on the end of the shank portion so that rear wall 20 extends from the surface of the shank portion by a sufficient distance for the head to be gripped by the fingers for initial turning of the handle when starting to turn a screw into place. For this purpose the outer cylindrical surface of the head near the back wall may be knurled as indicated at 30 in FIG. 1.

The socket 28 in the above size typically extends about one inch from the open end to the back wall of the socket and has a depth of about ⅔" from the open side to the base of the socket to define a generally U-shaped socket the bottom wall of which is flush with the inner end of the shank portion as best shown in FIG. 2. The width of the socket typically is about ½" which is sufficient to accommodate the short end of the Allen wrench in several sizes.

The wrench 12 is held in position by means of a latch 32 pivoted near one end thereof by a pin 34 passing through the head 16 near the back wall of the socket. The latch 32 in the illustrated embodiment is generally cylindrical and is formed with a relatively large opening 36 to receive the relatively narrow pin. It has been found that the large opening provides a good snap action for the latch when it is being opened and closed. The inner end of the latch forms into a bevelled tip 38 which bears against a leaf spring 40 at the rear of the socket. The action between the latch 32 and the leaf spring is such that the latch may be snapped into either an open or a closed position. The outer end of the latch is tapered to facilitate opening the latch as by the use of the thumb.

The leaf spring 40 is formed with a relatively narrow straight portion 42 terminating in a narrow lip 44 at its lower end which is mounted between the head and the head end of the wrench handle 10. The outer end 46 is somewhat broader than the the lower portion and is bent forwardly to apply pressure to the bevelled tip 38 to provide the snap action for the latch. With the latch open the wrench 12 may be inserted in or removed from the handle. With the wrench in place, the latch is snapped down against the end of the wrench to hold it in place.

Referring now to FIGS. 3–6, there is illustrated a modification of the invention and, in this embodiment, a wrench 12 is held in position by means of spring clip 48 which is attached to the head by means of a rivet or screw 50 along the side of the head between the back wall and the start of a socket 52. The spring clip is formed with a flat portion 54 extending from the screw 50 to the point where it forms into a reversing U-bend 56 extending into the socket 52 by a distance sufficient to engage the side of the Allen wrench 12 placed therein. The pressure is sufficient to hold the wrench in place, but, by applying a lifting pressure to the spring clip, it may be raised out of the socket and pushed to one side to allow the wrench to be removed or replaced.

With the wrench in place it is held tightly and snugly within the handle with the driving tip of the wrench extending by a distance of perhaps ½" from the socket 52 sufficient to engage an Allen screw or the like with which the tool is being used. The long shank portion provides increased leverage and the relatively thick shank portion provides a much firmer and fuller grip to allow more pressure to be applied when needed. Insofar the shank portion extends fully into the head portion there is almost no pressure applied to the head portion so that there is no risk of the head being displaced from the shank portion since virtually all pressure is between the shank portion of the handle and the Allen wrench. In the event that excessive pressure is applied and the wrench snaps, all of the parts will be retained within the handle with very little risk of any part flying loose therefrom. If it is desirable to turn the wrench around in order to reach a deeply located Allen screw, it is a simple matter to remove the wrench from the handle and insert the short end of the wrench in its passage 58 with the long end thereof extending out through the socket 52.

In practice, it has been found desirable to make the back wall of the head somewhat concave in order to provide a position for a thumb when using the tool. The concave cup on the head assures a firmer and a more positive grip on the handle when using the device to turn screws and the like.

Figure 7:
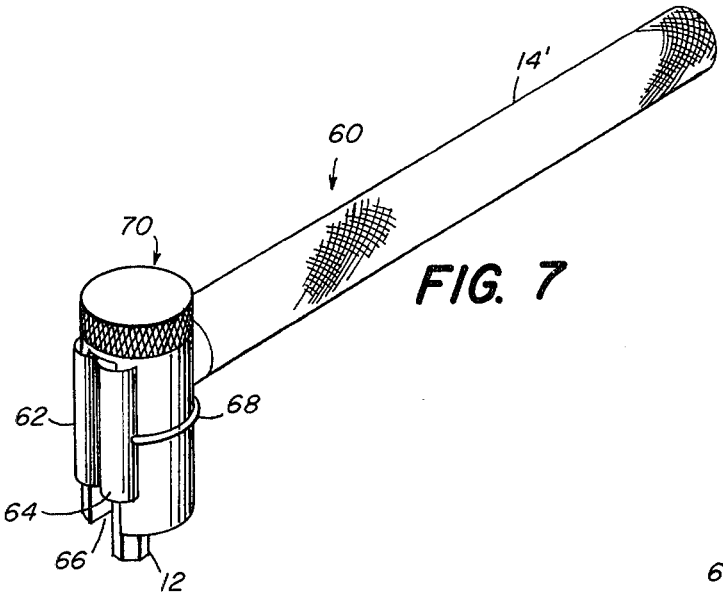
FIG. 7 is a perspective view showing a modification of the invention
Figure 9:
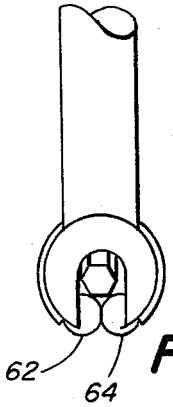
FIG. 9 is a detailed front view showing the head portion thereof.
Figure 8:
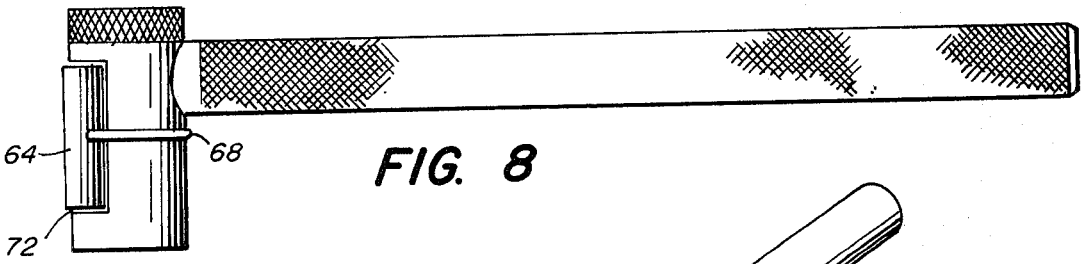
FIG. 8 is a view in side elevation of the FIG. 7 device.

Referring now to FIGS. 7, 8 and 9, there is illustrated another modification of the invention and, in this embodiment, a handle 60, generally similar to the handle 10 of the principal embodiment, is provided with different means for holding a wrench 12 in position. In the embodiment in FIGS. 7 through 9 a pair of spring loaded retainers 62 and 64 are provided across a socket 66. The retainers typically are relatively short cylindrical pieces of metal or plastic, one on either end of a C-shaped spring clip 68 extending about a head 70. The retainers 62 and 64 are seated in semi-cylindrical grooves 72 formed in the head on opposite sides of the socket with sufficient clearance to allow the retainers to spread apart by an extent sufficient to pass the wrench 12 therethrough. The wrench may be initially placed in position by passing the long end of the wrench between the retainers, causing them to spread apart, and then forcing the wrench into the handle so that the driving tip extends from the head in the manner illustrated. Once the short portion of the wrench passes into the socket and seats therein, the retainers will snap together, closing the socket along the end thereof and engaging the short portion of the wrench as best shown in FIG. 9. The tool may be readily removed by the pulling of the tip of the wrench with a force sufficient to spread the retainers apart and allow the tool to be fully withdrawn.

Figure 10:
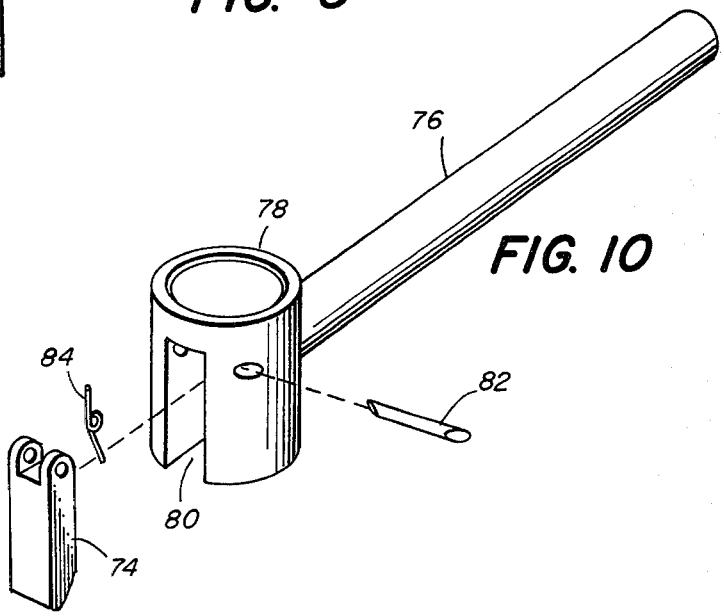
FIG. 10 is an exploded perspective view showing another modification of the invention, and, FIG. 11 is a sectional view in side elevation of the FIG. 10 device.
Figure 11:
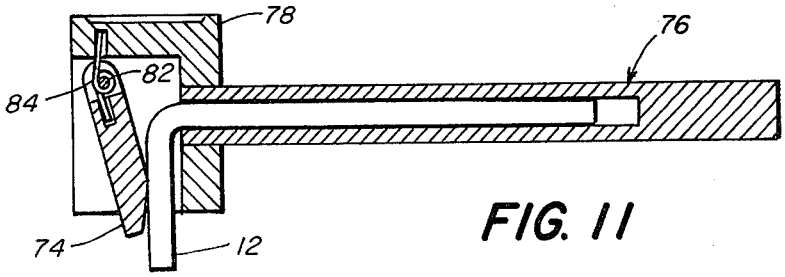

Referring now to FIGS. 10 and 11, there is illustrated another modification of the invention and, in this embodiment a spring-loaded keeper 74 is employed to hold a wrench 12 in a handle 76. The handle 76 and its head 78 are similar to those in the principal embodiment. However, instead of a spring clip to hold the wrench in place, the keeper 74 is utilized. The keeper 74 is hinged near the back of a head socket 80 by means of a roll pin 82. The keeper is provided with a spring 84, one end of which engages the inner end of the keeper and the other end of which engages the head with the center portion coiled about the pin. The spring normally urges the keeper into the closed position shown in full line in Fig. 11 to bear against that portion of the wrench within the socket. By raising the keeper into the open position shown in dotted line, the wrench may be removed or replaced.

While the invention has been described with particular reference to the illustrated embodiments, numerous modifications thereto will appear to those skilled in the art.

Having thus described the invention, What I claim and desire to obtain by Letters Patent of the United States is:

1. A handle for use with an L-shaped tool, comprising (a) a tubular shank portion formed with an axial passage of a length and width sufficient to accommodate the long leg of said tool, (b) a head disposed at one end of said shank portion and formed with a socket therein open to said passage, to one end of said head and to one side directly opposite said passage, and, (c) retaining means extending across said one side of said head to restrain that portion of said tool located in said socket, (d) said retaining means including a resilient member engageable with said head and extensible into said socket, (e) said resilient member being an elongated leaf spring secured at one end to said head adjacent said socket and normally extending into said socket to engage that portion of said tool located therein, said spring being movable in and out of said socket and to the sides thereof to permit insertion and removal of tools to and from said handle.

2. A handle according to claim 1 wherein said spring is formed with a generally flat portion extending from said one end to the mid portion thereof and formed with a generally U-shaped bend at the free end thereof, said U-shaped bend extendable into said socket to permit manual engagement thereof to move said spring in and out of said socket.

3. A handle according to claim 1 wherein said head is formed with a concave face in the end thereof opposite said one end.

4. A handle according to claim 1 wherein said head is generally cylindrical with the axis thereof perpendicular to the length of said handle, both ends of said head extending to opposite sides of said handle, and the end opposite said one end being knurled about the cylindrical outer surface thereof.

5. A handle for use with an L-shaped tool, comprising (a) a tubular shank portion formed with an axial passage of a length and width sufficient to accommodate the long leg of said tool, (b) a head disposed at one end of said shank portion and formed with a socket therein open to said passage, to one end of said head and to one side directly opposite said passage, and, (c) retaining means extending across said one side of said head to restrain that portion of said tool located in said socket, (d) said head being generally cylindrical with the axis thereof perpendicular to the length of said handle, both ends of said head extending to opposite sides of said handle, and the end opposite said one end being knurled about the cylindrical outer surface thereof.

6. A handle for use with an L-shaped tool, comprising (a) a tubular shank portion formed with an axial passage of a length and width sufficient to accommodate the long leg of said tool, (b) a head disposed at one end of said shank portion and formed with a socket therein open to said passage, to one end of said head and to one side directly opposite said passage, and, (c) retaining means extending across said one side of said head to restrain that portion of said tool located in said socket, (d) said retaining means including a pair of retainers moveably and resiliently mounted to said head at the mouth of said socket, said retainers adapted to be spread apart under applied pressure to open said socket and to close against one another when released to close said socket.

7. A handle according to claim 6 wherein said retainer means includes a generally C-shaped spring extending about said head and connected to a retainer at the end of each leg thereof.

8. A handle for use with an L-shaped tool, comprising (a) a tubular shank portion having opposed ends and formed with an axial passage opening through at least one end thereof and being of a length and width sufficient to removably receive and support one leg of the tool, (b) a head at said one end of said shank portion, said head having a side opposite said one end of said shank portion, and an end, a socket in said head generally perpendicular to the axial passage to accommodate the second leg of the tool, said socket having laterally spaced sidewalls and a bottom wall, said bottom wall extending from the end of the head generally perpendicular to the axial passage opening, said socket defining a continuous opening through the opposite side of said head and the end of the head, from a point generally aligned with the axial passage to said socket bottom wall, said socket, through said bottom wall, opening to the axial passage, (c) tool retaining means extending across said opposite side of said head to restrain the second leg of said tool located in said socket, and, (d) said retaining means including a spring-loaded keeper pivotally mounted to said head about an axis offset from said passage for movement between a position closing at least a portion of said continuous opening, and a position allowing free access through said continuous opening.

9. A handle according to claim 8 wherein said passage extends the full length of said handle and is open at both ends thereof.

* * * * *